United States Patent [19]

Olsen

[11] Patent Number: 4,511,147

[45] Date of Patent: Apr. 16, 1985

[54] GOLF SWING TRAINING CLUB

[76] Inventor: William A. Olsen, 594 W. 2050 North, West Bountiful, Utah 84087

[21] Appl. No.: 520,060

[22] Filed: Aug. 3, 1983

[51] Int. Cl.[3] ..... A63B 69/36

[52] U.S. Cl. ..... 273/193 A; 273/80 C; 273/81.4; 273/169

[58] Field of Search ..... 273/81.4, 80 C, 193 R, 273/193 A, 193 B, 194 R, 194 A, 167 G

[56] References Cited

U.S. PATENT DOCUMENTS

| | | | |
|---|---|---|---|
| 2,046,191 | 6/1936 | Smith | 273/81.4 |
| 2,146,048 | 2/1939 | Barnhart | 273/80 C |
| 2,628,100 | 2/1953 | Beebe | 273/81.4 |

FOREIGN PATENT DOCUMENTS

| | | | |
|---|---|---|---|
| 1024839 | 4/1966 | United Kingdom | 273/80.2 |

*Primary Examiner*—George J. Marlo

*Attorney, Agent, or Firm*—Mallinckrodt, Mallinckrodt, Russell & Osburn

[57] ABSTRACT

An invention in a golf swing trainer device having a weighted head with an appearance that is similar to an enlarged iron golf club, and includes a shaft that is bent oppositely at spaced apart points therealong, to off-set a lower shaft portion outwardly from an upper shaft portion. The head is secured on one shaft end and a hand grip is telescoped over the other that includes contoured depressions to accommodate a golfer's fingers closed therearound and has elevated portions for fitting the V areas between the thumb and forefinger of a golfer's hands therealong, the grip for exactly positioning the golfers hands relative to the trainer shaft and head. The weighted head is formed from a metal rod that is bent into the general shape of a head of the enlarged club iron, such that the weight thereof will be centered outwardly and above a head center point and is open to provide a minimum air resistant when the trainer is swung.

11 Claims, 10 Drawing Figures

GOLF SWING TRAINING CLUB

BACKGROUND OF THE INVENTION

1. Field of the Invention

The field of this invention relates to devices for training a golfer to execute a golf club swing that has a preferred extension, release and follow through.

2. State of the Art

Whether a beginner, a low handicapper or week-end golfer, it is every golfer's desire to consistantly execute a perfect well-timed swing where everything comes together in an easy relaxed motion. In such a swing the club head will meet the ball at an optimal attitude and will continue along the target line, propelling the ball flight where the golfer has aimed it. To occasionally execute such a swing provides a peak experience to any golfer's game.

A golf swing is a sequential occurance of a number of actions or elements. An improper execution of any one or more of these actions will produce other than an optimum swing. And while such elements can be evaluated individually, it is their flowing sequential execution that provides a dynamic interrelationship to produce a desired golf swing. Individually, the actions or elements that make up the preferred golf swing can be summarized as; the hand placement on the club and the club extension, release, and follow-through as the club is swung. These elements occur sequentially, with the upper body rotating as the club is swung and a weight transfer occuring from one leg to the other. During extension, the golfer's weight is on his back leg, with, at release, it is evenly distributed, and at follow-through, his weight will have transferred to his leading leg.

The present invention provides a dynamic training system whose repeated use will recondition a golfer to perform a proper golf swing. Whereas, earlier devices and arrangements have addressed improving or modifying aspects of the swing only. For example, certain earlier devices have dealt with club grips for positioning a golfer's hands around the club grip and, to that end, have provided grooves, finger pads, and ridges to fit the contours of his hands. Some such grips are shown in patents by Papin, U.S. Pat. No. 1,638,454; English, U.S. Pat. No. 3,111,322; Beebe, U.S. Pat. No. 2,628,100; Smith, U.S. Pat. No. 2,046,191; and Ottman, U.S. Pat. No. 2,298,505.

Additional to earlier U.S. Patents dealing with club grips, an earlier patent by Barnhart, U.S. Pat. No. 2,146,048, recognized a benefit to weight displacement in using a bent golf club shaft. This weighted shaft arrangement was, however, intended only to dampen a shock imparted into the golf club shaft when the head struck a golf ball.

Additionally, a bent shaft and weighted head arrangement is shown for a golf swing training device in a patent by Strahan, U.S. Pat. No. 3,351,346. This swing trainer, however, while it recognizes a benefit to a bent shaft and a weighted end displaced from a golf swing center line, is significantly different in structure from the trainer of the present invention in that it teaches a trainer shaft having a single bend only and it arranges a weight to encircle the shaft and to be adjustable vertically thereon. Also, the Strahan trainer is used to retrain a golfer to perform an inside-out golf swing correcting only a single aspect of the swing.

SUMMARY OF THE INVENTION

It is, therefore, a general object of the present invention to provide a golf swing trainer for use by a golfer to train himself to consistently perform a well-timed, well-executed golf swing, the club head finishing high and along a desired target line.

Another object is to provide a golf swing trainer, where, with practice, a golfer will imprint on his mind a proper and preferred golf swing that he can then consistently execute with a conventional golf club.

Still another object of the present invention in a golf swing trainer is to provide a device that has essentially a standard golf club configuration for swinging as a golfer would normally swing a conventional golf club.

Still another object of the present invention in a golf swing trainer is to provide a trainer that can be used without prior preparation or set-up when time allows, to provide, with repeated use, muscle conditioning, a mental imprinting, and motion blending and reinforcement of a desired golf swing.

Still another object of the present invention in a golf swing trainer is to provide a trainer similar to a golf club that includes a grip that is contoured for exact positioning of the golfer's hands and can be used repeatedly without wear.

In accordance with the above objects, the present invention in a golf swing trainer provides a device that is arranged essentially as a conventional golf club, that has a shaft that is bent at spaced points to off-set a lower end thereof from the shaft upper portion, to which shaft lower end, a weighted head is connected. The end of the upper shaft portion includes a grip contoured to accommodate and properly position a golfer's hands closed therearound. The shaft bends, respectively, are at the same angles, one above and the other below the plane of the shaft at spaced apart points. Thereby, the shaft sections or segments above and below the bends will be approximately parallel to one another and the head end thereof, will be offset with respect to the upper section whereon the grip is secured. The bends are spaced apart a distance to provide the desired off-set of the end whereto a weighted club head is secured from what would be the line of the shaft of a conventional golf club, also known as the golf club effective center line.

So arranged, in swinging the trainer, the off-setting of the head a distance from the effective center line provides a castering effect after the weighted club head has swung through the bottom of the swing arc, just below where it would contact a golf ball. Also, both the shaft off-set and the weighted head, when the trainer is swung, provide an accentuation to the left and right side extension of the golfer's body and rolling action of the golfer's hands, one over the other, at release.

The club head is preferably significantly heavier than is a normal golf club head, and that head is construed such that its mass is centered at a point outwardly from and above the head center with respect to where the shaft end connects to the head. To provide the desired weight distribution, the trainer head is preferably made from a metal bar stock that is bent through several angles back on itself such that the greater percentage or portion of that head is centered at a point outward from and above the head center. Also, the area within the bent bar stock is left open to minimize air resistance when swung, and the bar stock is preferably coated with a plastic or like resilient material.

The head weight and its off-set arrangement when the trainer is swung provides an emphasis to all the elements of a golf swing. The weight positioning creates a moment whereby, that club head will tend to finish higher, travel faster, and emphasizes the roll-over of the hands over one another at release. Thereby, a dynamic interrelationship between the golf swing elements is provided. A golfer, properly positioning his hands around the grip, can swing the trainer through extension, release and follow-through, with the trainer head weight and its arrangement causing him to be more aware of each aspect of his swing as well as conditions his muscles to later consistently perform the same swing smoothly and uniformly with a conventional golf club.

In practice, when the trainer is drawn back prior to swinging, the weighted head encourages a full extension. During the swing, when the head travels through a lowest point just below where a ball would be positioned, the off-set head weighting arrangement pulls the golfer's hands through a proper release. The weighted head then tends to hold its path of travel along the target line through follow-through. The weighted head and its location away from a normal club effective center line, during a swing, also acts to pull a golfer's weight from one side to the other, the upper body rotating therewith.

BRIEF DESCRIPTION OF THE DRAWINGS

The drawings illustrate that which is presently regarded as the best mode for carrying out the invention:

FIG. 1(*a*), a frontal view of the preferred golf swing trainer shaft with sections and angles thereof identified with letters;

FIG. 4(*b*), a view like that of FIG. 4(*a*), showing the golfer also gripping the contoured grip with his right hand;

DETAILED DESCRIPTION

A golf swing involves moving the head of a golf club, whether it be an iron or wood, through a golf ball, catching that golf ball in the head center after it has passed through a lowest point in the swing and is on the rise and, for an optimum golf swing, is square with the ball target line. A number of elements go into this optimum golf swing including, the grip whereby the golfer holds the club so as to control it while still allowing for wrist movement with his muscles relaxed and under minimum tension. With a proper grip, a muscle interaction can be obtained such that a golfer will be able to develop a maximum release action or second lever hand rotation in the swing. Second lever hand rotation is, of course, where the one wrist rolls over the other after the club head has moved through the golf ball. A desired or desirable golf swing, as for a right handed golfer, involves the golfer pivoting the golf club back over his head, extending his left side with his weight on his back or rear most foot. Then, when the club is swung the golfer's left side is relaxed, and his weight shifts off from his back leg to a point of even distribution across his legs as the club head passes through a bottom most point. As the swing continues, the club will travel through a release attitude or a point of second lever rotation where the golfer's right wrist and hand is rolled over his left after the golf ball has been hit. At and after release, the club head tends to continue down the target line, and the golfer's weight shifts to his forward leg as the body rotates with the swing. Thereafter, the club head finishes in a high arc, his right side extending as his left side collapses. The golf swing trainer of the present invention provides with repeated use, for a correction or improvement in the execution of these elements or components of a golf swing by providing a muscle condition and making the golfer more aware of each swing aspect, providing an emphasis of the proper swing characteristics and developing a mental imprinting thereof that the golfer can apply to swinging a conventional golf club.

Figure 1A:
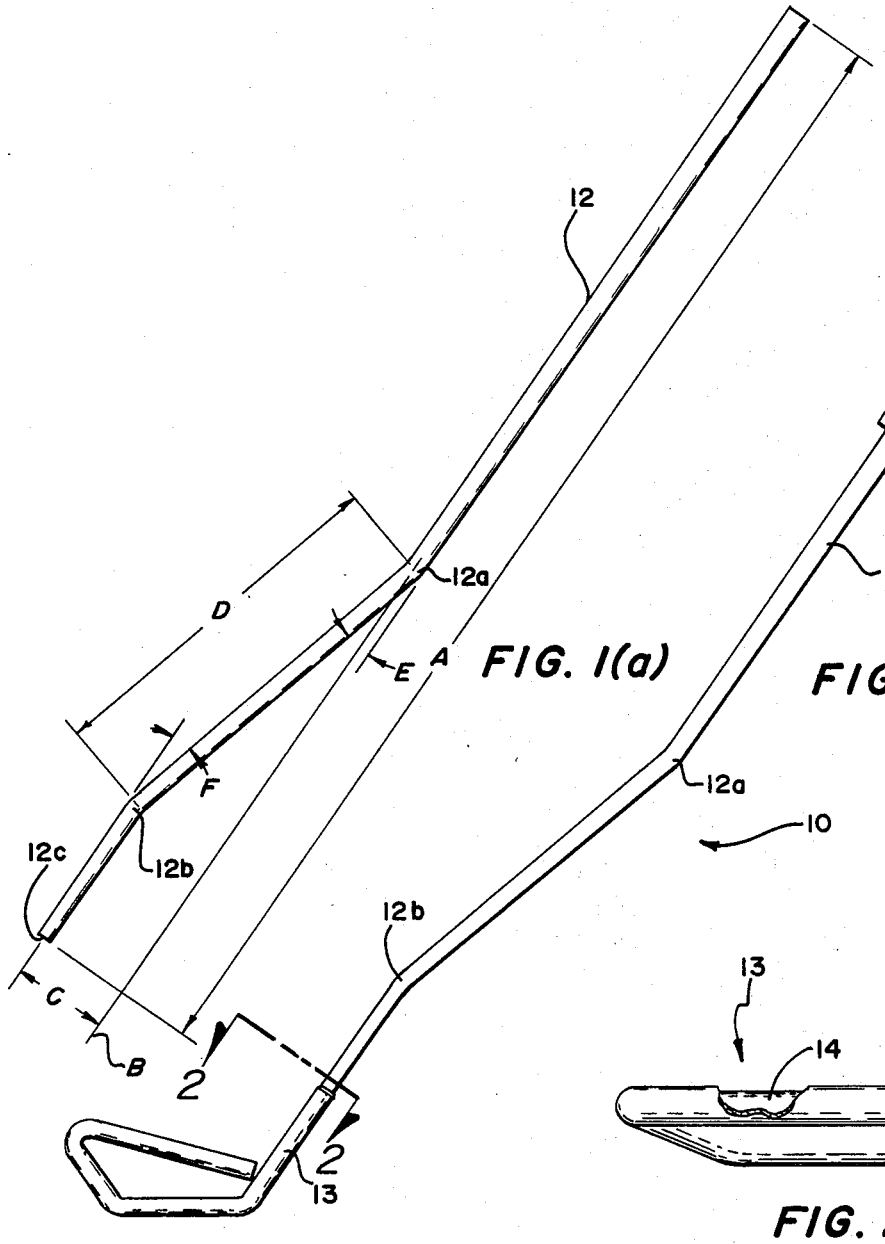
FIG. 1, a frontal view of a golf swing trainer of the present invention.
Figure 1:
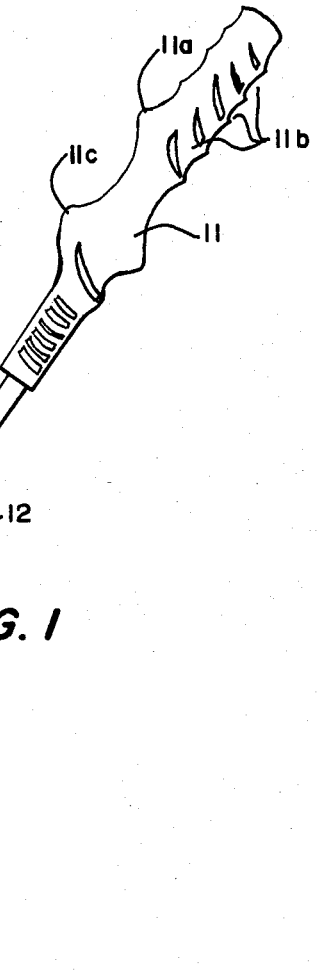
Figure 4:
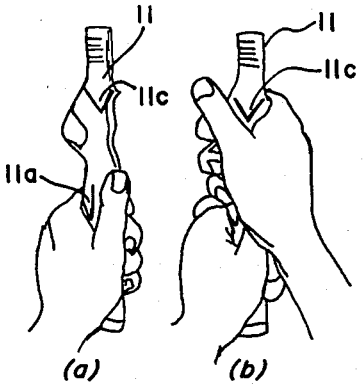
FIG. 4(*a*), a top plan view showing a golfer gripping the contoured grip of the golf swing trainer of FIG. 1 with his left hand.

FIG. 1 shows a frontal elevation view of a preferred arrangement of the golf swing trainer 10 of the present invention, hereinafter referred to as trainer. Shown therein, the trainer consists of a contoured grip 11 that is secured to one end of a hollow bent shaft 12 that has a head 13 secured to the opposite end. The grip 11, as set out later herein, with respect to a description of FIGS. 4(*a*) and 4(*b*), is arranged with appropriate ridges and depressions to receive and position a golfer's hands closed therearound. With the preferred grip, the golfer experiences minimal muscle tension with maximum muscle interaction such that he can develop a maximum second lever rotation where his hands rotate over one another.

The hollow bent shaft 12, hereinafter referred to as shaft, is also shown in FIG. 1(*a*), which Figure includes dimensions and angles identified with letters. Shaft 12 shown in FIGS. 1 and 1(*a*) is bent at 12*a* and 12*b* that are spaced apart points and are equal angles above and below the plane of the shaft. The bends provide an off-set to the lower shaft portion whereto the head 13 is secured. Thereby a center of mass or weight of the club head is off-set, with respect to what would be the effective center line of a conventional straight shaft golf club. This off-setting of the head weight or mass provides, when the trainer is swung, a desired torquing effect that accentuates the second lever rotation at release that occurs when the club head is swung past a lowest most point. Further, as will be described in detail later herein, the trainer head 13 is formed such that the weight of mass thereof, is centered beyond a center or midpoint with respect to that head's connection to the shaft end, providing thereby, an added torquing effect to the swing. The relationship of the head weight and the distance from the effective center line, as set out below, has been found to produce a desired torquing effect at release, the club head tending to properly roll or rotate at a desired point in the golf swing. Whereas, in practice, with a greater or lesser moment arm such as would result from a different head weight or different distance from the effective center line, the castering effect of the club head will occur too late or too early in that swing, the club head failing to rotate timely and the face thereof will be at other than a right angle to a point whereat it would contact a golf ball.

In FIGS. 1 and 1(*a*), the angles of bends 12*a* and 12*b* are identified as E and F. These angles are preferably the same angle, one above and the other below the plane of the shaft. So arranged, the upper and lower portions of the shaft 12 will be off-set from one another a distance C, which distance is taken from the shaft end 12*c* to a club effective center line, identified as B. Preferably, the length A of the shaft 12, taking into account the bends, will be approximately that of a conventional golf club, and length D of the section between bends 12*a* and 12*b* will be such as to effect the desired off-set distance C. In practice, a distance of $2\frac{1}{2}$ inches is preferred as the distance C, the off-set from the club effective center line. To provide this preferred $2\frac{1}{2}$ inch, plus or minus $\frac{1}{4}$ inch, off-set, for a length A of approximately 35 inches, angles of 12°, plus or minus 2°, have been used as angles E and F, and a shaft section D length of $9\frac{1}{4}$, inches plus or minus a $\frac{1}{4}$ inch, has been used. So arranged, the desired $2\frac{1}{2}$ inch off-set is obtained, that, in conjunction with the head 13 weighting as set out herein below, will induce a properly timed releasing action or second lever hand rotation for training this aspect of the golfer's swing.

Figure 2:
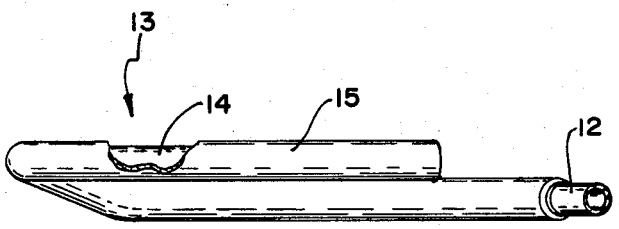
FIG. 2, a top plan sectional view taken along the line 2—2 of FIG. 1 showing the head connected to a lower end of the bent shaft.
Figure 3:
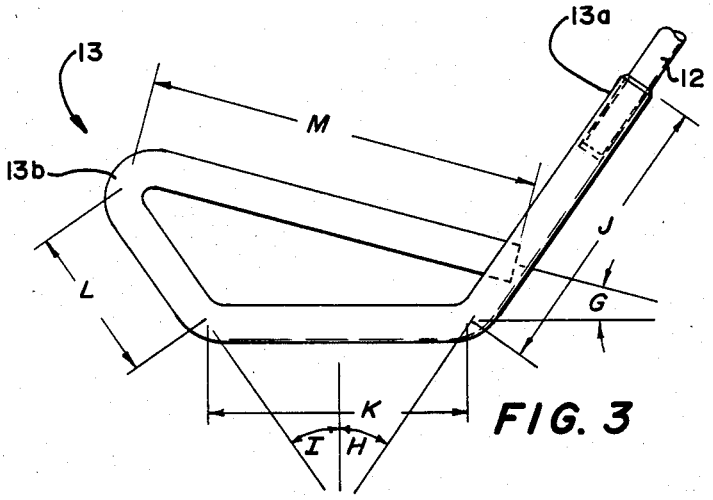
FIG. 3, a frontal view of the head of FIG. 2, identifying with letters the preferred angles and lengths of the sides of that head.

FIG. 2 shows a top plan sectional view of a preferred arrangement of the head 13 secured to the end 12*c* of shaft 12. A section of that head is shown removed revealing that the head is preferably formed from a section of round bar stock 14 that is preferably iron or steel and is coated with a plastic material 15. The bar stock is bent through a number of angles back on itself, to a general shape of the head of a golf club commonly known as an "iron", as shown in FIGS. 1 and 3, and has an open center area. The preferred dimensions and bend angles of head 13 are identified in FIG. 3 with letters. Preferably, the head 13 is formed such that its weight or mass will be centered further from the shaft connection than would be the weight or mass of a conventional club head, and the head 13 is significantly heavier than is the head of a conventional golf club, either a wood or an iron. In practice, a head weight of approximately 13 ounces, plus or minus 1 ounce, has been used successfully and the weight thereof is distributed, as will be described herein below with respect to description of FIG. 3, so as to produce the required torquing action to train the golfer to perform the desired second lever effect as set out herein above.

In practice, for measuring the moment arm to calculate torquing effect, the center of mass of the head is, of course, added to the distance D, of that shaft from a club effective centerline, as illustrated in FIG. 1(*a*). The head weight is perferably further off-set outwardly from the club head center, as shown in FIG. 3, by appropriately bending the metal bar stock 14 at the angles shown as angles G, H, and I. These angles in practice are, respectively: G, 15° plus or minus 2°; for H, 36° plus of minus 2°; and for I, 35° plus or minus 2°. The shaft end 12*c*, shown in FIG. 1(*a*), is telescoped into the head end at 13*a*, shown in FIG. 3, that is an extension of length J, and is approximately 4 inches. In practice, the head is bent at G such that the bottom or base length K thereof, will be approximately parallel to the ground surface when the trainer is held as shown in FIG. 1. The particular bends shown at angles H and I and lengths K, L, and M are selected such as to form a "toe" 13*b* end of the head, the weight or mass of that head thereby concentrated outward and upward along horizontal and vertical planes crossing through a head center point. Preferably in practice, length K is approximately $3\frac{3}{4}$ inches, length L is approximately $2\frac{1}{2}$ inches, and length M is $5\frac{3}{4}$ inches. The round bar stock is selected to have a weight, as set-out above of approximately 13 ounces, plus or minus 1 ounce, and the center of weight or mass thereof, will thereby be approximately 7/12 of an inch plus or minus $\frac{1}{3}$ of an inch beyond the center thereof taken from where the shaft end connects to the head.

As shown in FIG. 3, the head center is open to provide passage of air therethrough, minimizing the air resistance created by swinging the trainer. Additionally, the upward displacement, or toe end 13*b* thereof provides provides a moment arm that is slightly elevated above the horizontal as would exist with a conventional club head, and this moment arm arrangement encourages the described head rotation during release. It has been found in practice that if the overall trainer weight, including grip, is approximately 20 ounces, the trainer will measure approximately "H-O" on a patented prorhythmic swing weight scale developed by Kenneth Smith Co. for measuring dynamic swinging weight of any given club.

As set out above, head 13 is significantly heavier than is that of a conventional club head. That increased head weight and the length of the shaft 12 provides, when the trainer is swung, a castering effect, the right wrist rolling over the left, and accentuating the above-described extension and compression of the body sides as the club head is swung through the full arc of travel. During follow-through, the weight of the head tends to hold it longer in the line of the ball flight, causing the swing to finish high. Such a finish is commonly known as a "Ben Hogan" finish.

As set out above, the trainer head 13 is preferably covered with an elastomer plastic material as by dipping it into a molten plastic bath, or the like. This is done for safety reasons and to provide the head with an attractive appearance. Also, by a selection of a colorful plastic as the covering, such as a yellow vinyl, a maximum optical contrast as related to the color of the ground can be obtained that will assist the golfer in following with his eyes, the trainer head during a swing.

As set out above, swinging the trainer provides to the golfer an emphasized extension, release and follow-through, training his muscles appropriately and making that golfer conscious of and imprinting on his mind, the needed muscle interaction. This emphasized muscle action and the mental imprinting of how the muscles should feel when a club is swung properly, will carry over to a golfer swinging a conventional golf club. This, of course, assumes that the golfer's hands are properly positoned on the grip 11 to allow for a proper rolling of the one over the other as occurs during release. To provide such a preferred grip, as shown best in FIG. 4(*a*), a golfer grips with his left hand the grip 11 such that area between his thumb and the forefinger will fit along the sides of a V-shaped section 11*a*. So arranged, the V between the golfer's thumb and forefinger of his left hand will be at the eleven o'clock position as seen by a person, such as an instructor, facing and looking at the golfer's hands. V 11*a* is raised and has converging lateral sides to accommodate the sides of the golfer's finger and thumb resting therealong and the undersurface of the grip 11, as shown in FIG. 1, has a number of notches or grooves 11*b* formed therein, for receiving golfer's fingers wrapped therearound. Shown in FIG. 4(*b*), the golfer has positioned his right hand somewhat over the thumb of his left hand and has fitted the area between his thumb and forefinger in a V 11*c*, that is like V 11*a*, and is off-set therefrom to approximately a twelve o'clock position as viewed by an instructor facing and looking at the golfer's hands. This V is substantially in the line of the shaft off-set and head, and is to receive the V between the golfer's thumb and forefinger of his right hand. The golfer then wraps his fingers around the grip, fitting them into the grooves 11*b* as shown in FIG. 1. Thereby, the golfer is provided with a comfortable and correct positioning of his hands, wherewith he will experience a minimal muscle tension that will allow him to develop a maximum second lever release velocity as the trainer is swung through and beyond an area where a ball would be located.

Figure 5:
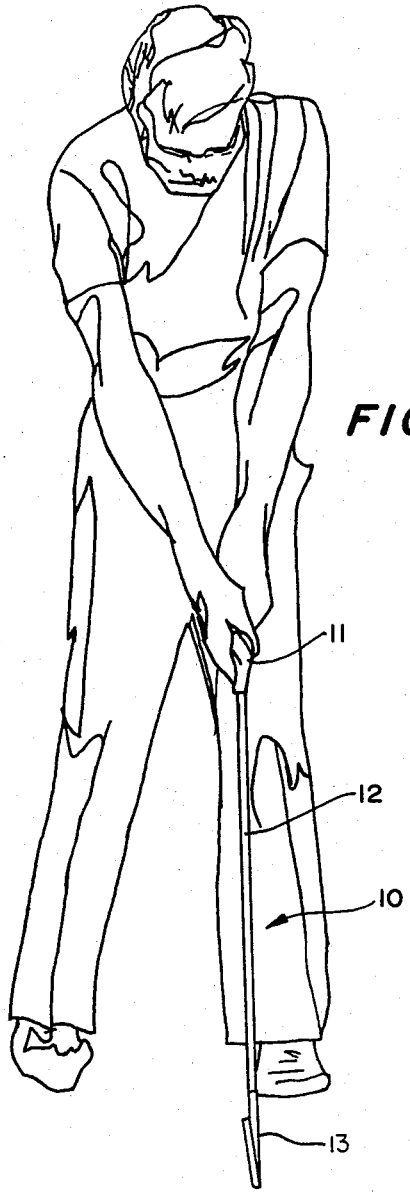
FIG. 5, a view of a golfer holding the golf swing trainer of FIG. 1 as he would when he addresses a golf ball.

In FIG. 5, a golfer holding the trainer 10 by grip 11 as described above is shown addressing an area on the ground where a golf ball would be located. That addressing establishes the flight path such a ball would travel in as a line at a right angle off the face of head 13.

Figure 6:
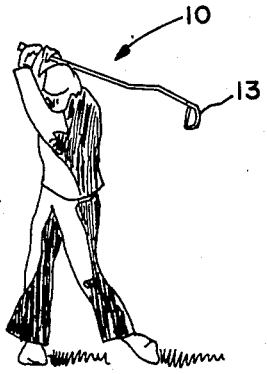
FIG. 6, a front elevation view of a golfer holding the golf swing trainer of FIG. 1 with the trainer swung behind his back in an extension position.
Figure 7:
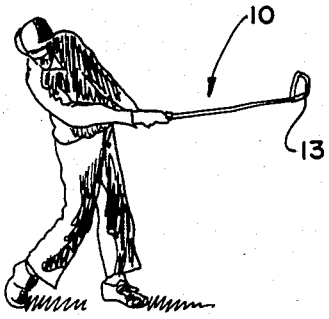
FIG. 7, a view like that of FIG. 6, only showing the golfer after he has swung the trainer through a lowest point and is in a follow-through position.
Figure 8:
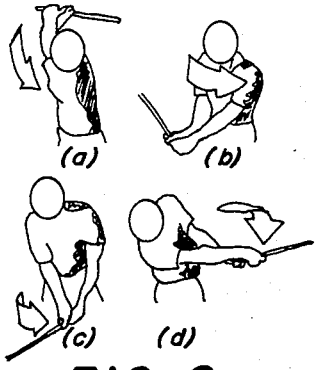
FIGS. 8(*a*),(*b*),(*c*) and (*d*), show representations of a golfer's upper body with arrows depicting travel and rotation of the golf swing trainer as it is swung.
Figure 9:
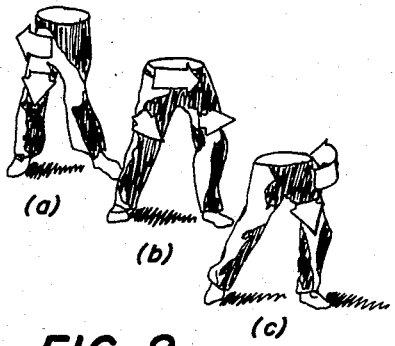
FIGS. 9(*a*),(*b*) and (*c*), show representations of a golfer's legs and torso as he swings the golf swing trainer from extension through a lowest point in the swing to follow-through, with arrows depicting the weight shift and body rotation that occurs during the swing.

FIG. 6 shows the golfer after he has pivoted the trainer 10 into an extension position, prior to beginning his swing, showing the head 13 swung back to a position of maximum extension of the golfer's left side. In this attitude, the golfer's weight, as shown in FIG. 9(*a*), is positioned mostly on his back foot. The golfer, as he swings the trainer head back to the extension position, feels the moment created by the head acting through the shaft 12 and is thereby made aware of the extension of his left side and the collapse of his right side, as illustrated in FIG. 8. Thereafter, the golfer swings the trainer illustrated by the (*b*) figure in FIG. 8, the momentum of the travel of the head 13 produces a greater torquing action than would be experienced swinging a conventional golf club. The trainer head tends to reach a maximum velocity at the bottom of the swing. During this portion of the swing, as shown in FIG. 9(*b*), the golfer's weight will shift off from his rear leg and is redistributed across both legs, with the upper torso rotating as shown. Thereafter, as the head 13 moves through a ball area, as illustrated in FIG. 8(*c*), the inertia developed by the head tends to hold it on the target line longer than with a conventional golf club as shown in FIG. 7. The trainer head thereafter, travels to a highest point in the swing, providing what is known as a "Ben Hogan" finish.

As illustrated in FIG. 8(*d*), after the trainer head has passed through the ball area, with the head traveling along the target line, a second lever torquing action occurs that is accentuated by the off-set head weight distribution and its distance from a golf club effective centerline. At release, the second lever torquing action provides an accentuation to the rolling action where the right wrist rolls over the left due to a castering effect. The harder the trainer is swung, the more this castering tendency of the right hand to roll over the left is accentuated, emphasizing that second lever rotation action. This emphasis tends to train the golfer to maintain better club head control. The accentuation to the second lever rotation and the high trainer head finish, tends to generate an improved directional control and the weighted head trains the golfer to swing the club harder, delivering a greater force of impact to the ball when a conventional golf club is substituted for the trainer. Additionally, swinging the trainer tends to accentuate the movement of the golfer's weight from his back leg to his forward leg during the swing, and the rotation of his upper body as illustrated in FIG. 9(*a*),(*b*), and (*c*).

Practice with the trainer 10 of the present invention accentuates what a golfer "feels" his muscles to be experiencing during the swing, making him more aware of each swing element as he performs it. Also, the trainer head weight and its distribution provides a moment arm effect during that practice that encourages a smooth transition between each element or action of the swing. Additionally, the weighted club head arrangement, relative to a golf club effective center line, encourages a golfer to transfer his weight in exaggerated fashion, which weight transfer assists the golfer in maintaining his balance throughout the swing. The weighted head arrangement encourages the proper castering effect during the release portion of a golf swing and, in fact, the harder the club is swing the more this tendency of the hands to rotate with respect to one another to create this second lever rotating action is accentuated. It is this accentuated second lever rotation that tends to generate better directional control and a greater distance of ball travel when applied to swinging a conventional club. All in all, practice of a golf swing with the trainer 10 enables the golfer to recognize or "feel" the proper sequence of actions that make up a desirable golf swing.

The trainer 10 of the present invention can be used by a golfer picking it up and swinging it any time he has a few spare moments. Through such repeated and redundant swinging a muscle conditioning and mental imprinting of the elements or aspects of the desired golf swing takes place, which will carry over to swinging a conventional golf club. Swinging the trainer provides a dynamic interaction between the components or aspects of the swing, that with practice, will smooth together. The irregularities and jerkiness that are traits of the average golf swing, will thereby be eliminated, and a blending of motion into a well-timed and flowing golf swing will be provided. In practice, it has been found that exercise with the trainer as at a $\frac{3}{4}$ metrodome pace will produce a very relaxed swing.

With redundant swinging of the trainer in a range of approximately 30 to 40 repetitions per minute, a novice golfer's speed of swing has been refined from 12 percent to 7 percent variation; an intermediate golfer's swing has been refined between 10 percent to 5 percent variation; and a low handicapper's swing has been refined from aproximately 7 percent to 3 percent in club head speed consistancy. Additionally, in all cases, the timing and the release action of each golfer's swing has improved as has the swing smoothness or tempo, and each golfer tested was observed to experience some relative improvement in squaring the club head relative to the target line.

While a preferred embodiment of the present invention in a golf swing trainer has been shown and described herein, it should be understood that the described embodiment is presently contemplated to be a best or preferred mode for carrying out the invention only and in actual practice can be varied and changes made thereto, without departing from the subject matter coming within the scope of the following claims, which claims I regard as my invention.

I claim:

1. A golf swing trainer comprising, a grip means for accommodating a golfer's hands closed therearound; a shaft having an end of an upper substantially straight portion thereof fitted to said grip means and a lower portion, said lower portion including a substantially straight portion positioned along an axis spaced from said upper portion and substantially parallel to the axis of said upper portion, said upper and lower portions being connected by a substantially straight portion connected to said upper and lower portions at substantially equal angles; and weighted head secured to the lower end of said lower shaft portion and extending outwardly therefrom, which head has an open center area.

2. A golf swing trainer as recited in claim 1, wherein the grip means is arranged for telescoping over the shaft upper portion end, aligned in the same plane with the weighted head, and includes a plurality of finger-receiving grooves and has a pair of raised portions extending outwardly, one substantially in the same direction as the head, which raised portions have converging lateral sides to accommodate the sides of a persons thumb and forefinger positioned therealong, for positioning the persons hands relative to said shaft and weighted head.

3. A golf swing trainer as recited in claim 1, wherein the offset distance between said upper and lower straight portions is two and one-half ($2\frac{1}{2}$) inches plus or minus one-quarter ($\frac{1}{4}$) inch.

4. A golf swing trainer as recited in claim 3, wherein the spacing distance between the bends is nine and one-half ($9\frac{1}{2}$) inches, plus or minus one-quarter ($\frac{1}{4}$) inch, the bend angles are twelve degrees (12°), plus or minus two degrees (2°), above and below the line of the shaft upper portion, for a shaft effective length of approximately thirty-five (35) inches.

5. A golf swing trainer as recited in claim 1, wherein the weighted head is constructed such that a center of mass thereof will be located outwardly from a vertical center line through the head center.

6. A golf swing trainer as recited in claim 1, wherein the weighted head is constructed such that a center of mass thereof will be located above a horizontal line through the head center.

7. A golf swing trainer as recited in claim 1, wherein the head is constructed of a metal round stock bent back upon itself in a general shape of an enlarged golf club head commonly known as an iron; and is coated with a resilient material.

8. A golf swing trainer as recited in claim 7, wherein the resilient material is a colored plastic.

9. A golf swing trainer as recited in claim 8, wherein the metal round stock is a cold rolled steel; and the resilient material is a yellow vinyl plastic.

10. A golf swing trainer as recited in claim 7, wherein the metal round stock is bent from a neck end that is connected to as an extension of the shaft lower portion end to form a base side that will be parallel to the ground when a golfer holds the trainer as he would addressing a golf ball, and from that base side is bent upwardly into a toe and thence back to the neck, forming the head.

11. A golf swing trainer as recited in claim 10, wherein the round stock is bent from a neck end of approximately four (4) inches at an angle of thirty-six degrees (36°), plus or minus two degrees (2°), into a base of approximately three and three-quarter ($3\frac{3}{4}$) inches, and therefrom is bent at an angle upward from that base of thirty-six degrees (36°), plus or minus two degrees (2°), for a length of approximately two and one-half ($2\frac{1}{2}$) inches, and thence is bent back into engagement with the shaft neck for a length of approximately five and three-quarter ($5\frac{3}{4}$) inches, to have a weight of thirteen (13) ounces, plus or minus one (1) ounce.

* * * * *